US011587716B2

(12) United States Patent
Spath et al.

(10) Patent No.: US 11,587,716 B2
(45) Date of Patent: Feb. 21, 2023

(54) INDUCTIVE COMPONENT AND METHOD OF MANUFACTURING AN INDUCTIVE COMPONENT

(71) Applicant: SUMIDA Components & Modules GmbH, Obernzell (DE)

(72) Inventors: Christoph Spath, Neukirchen vorm Walde (DE); Johannes Hofbauer, Grafenau (DE); Rainer Pilsl, Obernzell (DE)

(73) Assignee: SUMIDA COMPONENTS & MODULES GMBH, Obernzell (DE)

( * ) Notice: Subject to any disclaimer, the term of this patent is extended or adjusted under 35 U.S.C. 154(b) by 690 days.

(21) Appl. No.: 16/196,162

(22) Filed: Nov. 20, 2018

(65) Prior Publication Data

US 2019/0259523 A1 Aug. 22, 2019

(30) Foreign Application Priority Data

Feb. 22, 2018 (DE) ..... 10 2018 202 669.6

(51) Int. Cl.
*H01F 5/04* (2006.01)
*H01F 27/25* (2006.01)
(Continued)

(52) U.S. Cl.
CPC ..... *H01F 27/25* (2013.01); *H01F 5/04* (2013.01); *H01F 27/2828* (2013.01);
(Continued)

(58) Field of Classification Search
CPC ..... H01F 27/25; H01F 27/2828; H01F 5/04; H01F 27/306; H01F 27/325
(Continued)

(56) References Cited

U.S. PATENT DOCUMENTS 5,157,368 A * 10/1992 Okano ..... H01F 27/06 336/192
5,396,211 A * 3/1995 Noguchi ..... H01F 27/266 336/198

(Continued)

FOREIGN PATENT DOCUMENTS

CN 102163489 8/2011
CN 103035364 4/2013

(Continued)

OTHER PUBLICATIONS

Korean Office Action in corresponding Korean application No. 10-2018-0160738, with English translation; 11 pages.

(Continued)

*Primary Examiner* — Elvin G Enad
*Assistant Examiner* — Joselito S. Baisa
(74) *Attorney, Agent, or Firm* — Fattibene and Fattibene, LLC; Paul A. Fattibene

(57) ABSTRACT

A inductive component is provided, which comprises a magnetic core, an insulation body formed of an electrically insulating material and having the magnetic core accommodated therein, and a coil body having at least one winding wound thereon. The insulation body comprises at least two mechanically connected insulation wall sections, which each face, at least partially, a respective side surface section of the magnetic core. The coil body comprises at least one contact element attached to a side surface section of the coil body and used for establishing an electric connection to the at least one winding, and a magnetic core accommodation in which the magnetic core accommodated in the insulation body is partially accommodated. A side surface section of the magnetic core, which faces the contact element, is covered, at least partially, by an insulation wall section of the insulation body.

18 Claims, 4 Drawing Sheets

(51) Int. Cl.
*H01F 41/02* (2006.01)
*H01F 27/32* (2006.01)
*H01F 27/28* (2006.01)
*H01F 27/30* (2006.01)

(52) U.S. Cl.
CPC ..... *H01F 27/306* (2013.01); *H01F 27/325* (2013.01); *H01F 41/022* (2013.01); *H01F 2005/043* (2013.01)

(58) Field of Classification Search
USPC ..... 336/213
See application file for complete search history.

(56) References Cited

U.S. PATENT DOCUMENTS 5,719,544 A * 2/1998 Vinciarelli ..... H01F 27/36 336/84 C
6,255,931 B1 7/2001 Chen ..... 336/198
7,199,694 B2 * 4/2007 Hao ..... H01F 27/324 336/200
7,724,115 B2 * 5/2010 Chen ..... H01F 27/326 336/131
7,772,957 B2 * 8/2010 Chen ..... H01F 27/325 336/212
8,643,460 B2 * 2/2014 Tseng ..... H01F 27/06 336/212
8,730,000 B2 * 5/2014 Suzuki ..... H01F 27/263 336/212
8,922,318 B1 * 12/2014 Peng ..... H01F 27/325 336/208
9,183,974 B1 * 11/2015 Folker ..... H01F 27/306
9,437,360 B2 * 9/2016 Yang ..... H01F 27/306
9,627,124 B2 * 4/2017 Satoh ..... B29C 45/14639
9,646,755 B2 * 5/2017 Lint ..... H01F 27/02
2006/0226945 A1 * 10/2006 Maekawa ..... H01F 38/12 336/90
2007/0273466 A1 * 11/2007 Yang ..... H01F 38/10 336/220
2008/0100407 A1 * 5/2008 Yamaguchi ..... H01F 5/04 336/192
2009/0009276 A1 1/2009 Jidaisho ..... 336/90
2010/0026445 A1 * 2/2010 Lin ..... H01F 27/266 336/84 R
2010/0033284 A1 * 2/2010 Yamakami ..... H01F 27/324 336/221
2011/0037553 A1 2/2011 Gerhard et al. ..... 336/192
2011/0090037 A1 * 4/2011 Tsai ..... H01F 27/324 336/220
2011/0115595 A1 * 5/2011 Tseng ..... H01F 27/29 336/192
2011/0187485 A1 8/2011 Toyoda et al. ..... 336/192
2013/0249659 A1 * 9/2013 Tseng ..... H01F 27/06 336/65
2014/0306785 A1 10/2014 Maier et al. ..... 336/90
2015/0048914 A1 * 2/2015 Satoh ..... B29C 45/401 336/90
2015/0179331 A1 * 6/2015 Su ..... H01F 27/2828 336/199
2017/0164480 A1 * 6/2017 Liu ..... H01F 27/28

FOREIGN PATENT DOCUMENTS

| | | |
|---|---|---|
| DE | 102006029272 | 12/2007 |
| DE | 102013206453 | 10/2014 |
| DE | 112013005380 | 8/2015 |
| EP | 2012330 | 1/2009 |
| JP | 2000 049020 | 2/2000 |
| JP | 2006278727 | 10/2006 |
| JP | 2017195293 | 10/2017 |
| WO | WO 9705632 | 2/1997 |
| WO | WO 2014 072062 | 5/2014 |

OTHER PUBLICATIONS

European Search Report dated Feb. 21, 2019 in corresponding European application 18 19 2874; 9 pages.
Office Action dated Mar. 8, 2019 in corresponding German application No. 10 2018 202 669.6; 3 pages.
Chinese First Office Action dated Dec. 18, 2020 in corresponding Chinese application No. 201811457515.9, with English translation; 14 pages.
Chinese First Search Report in corresponding Chinese application No. 201811457515.9, English translation; 2 pages.
Canadian Office Action dated Aug. 28, 2019 in corresponding Canadian application 3021650; 4 pages.
Japanese Office Action in corresponding Japanese application No. 2018-202782; 3 pages.

* cited by examiner

INDUCTIVE COMPONENT AND METHOD OF MANUFACTURING AN INDUCTIVE COMPONENT

FIELD OF THE INVENTION

The present invention relates to an inductive component and to a method of manufacturing an inductive component and, in particular, to the compliance with insulation requirements for very compact inductive components.

BACKGROUND OF THE INVENTION

Inductive components, such as transformers and chokes, are used in a plurality of fields of application. One field of application are electronic systems in automobiles, where inductive components are used, inter alia, as ignition transformers for gas discharge lamps or filter chokes, by way of example. The extensive developments in automotive electronics that have been promoted in the automotive industry led to a significant increase in the number of electronic components, e.g. for use in vehicles as instrument clusters, which are used for displaying data in automotive vehicles, for controlling the engine control with control of the ignition system or the injection system, in anti-lock braking systems and vehicle dynamics control systems, in the control of airbags, in body control units, in driver assistance systems, in car alarm systems and multimedia devices, e.g. navigation systems, TV tuners, etc.

The increasing number of electronic devices in automobiles as a result of this development necessitates e.g. further adjustments of the electronic components as regards their size, so as not to exceed the installation spaces given in the automotive vehicle through the vehicle design in question, in spite of the increasingly extensive and complex electronic systems used in automotive vehicles. In general, there are further demands on the electronic system in automotive vehicles as regards robustness, temperature range (e.g. a guarantee of operability in a temperature range from −40° C. to about 120° C.), resistance to vibrations and shocks (caused by shaking during vehicle operation), etc., whereby the reliability of the electronic system should be guaranteed with respect to a great variety of conditions and states over the longest possible period of time.

In addition to the application-related conditions concerning a component size, which aims in particular at a more compact structural design of electronic components so as to comply with given installation spaces, e.g. a given mounting area, which is the maximum mounting area that an electronic component is allowed to occupy on a carrier, such as a printed circuit board, to which the electronic component is to be attached, generally specified safety standards must be observed by all means, without, in turn, impairing the performance and the quality of electronic components. For example, safety standards for realizing uniform minimum safety standards specify insulation requirements to be met by electronic components, such as the compliance with specified air and leakage paths and the compliance with a specified dielectric strength.

In general, an air path is here defined as the shortest distance between two conductive parts, especially the shortest possible connection via air, across recesses and gaps and transversely through insulating attachments, which are not connected in full area and without any gaps to the underground. The air path depends, inter alia, on the voltages applied, electronic components being assigned to predefined overvoltage categories. The overvoltages that have to be taken into account in this respect are those entering the electronic component from outside via connections (e.g. connecting terminals of an electronic component) as well as those generated in the electronic component itself and occurring at the connections. Predefined air paths are intended to prevent a voltage breakdown from occurring over possible shortest connections through air. In this sense, air paths limit maximum possible electric fields in air, so that no breakdown will occur.

The leakage path, however, is the shortest possible connection between two potentials via a surface of an insulating material arranged between the two potentials. The leakage path generally depends on the effective operating voltage of an electronic component and is influenced e.g. by the degree of contamination and/or the degree of moistening of a surface of an insulating material. For example, a tracking resistance of an insulating material is determined by the insulation resistance of a surface of the insulating material under the influence of moisture and/or contamination, and may be understood as defining the maximum leakage current that is allowed to occur in a defined test arrangement under standardized test conditions. The tracking resistance depends essentially on the water absorption capacity and the behaviour of an insulating material under thermal stress.

In addition, the insulation distance is understood as the strength of an insulating material, so that this value is important for determining the dielectric strength of an insulating material.

From safety standards that make demands on air paths, leakage paths and insulation distances, constraints result, depending on the dimensions of an electronic component, for a sufficient insulation so as to avoid voltage breakdowns (e.g. electric arcs or sparking) and/or leakage currents as a potential safety risk. For example, voltage breakdowns in the form of electric arcs or sparking will have to be avoided in the context of explosion protection, while leakage currents are a safety risk for a user who comes into contact with a leakage current source.

SUMMARY OF THE INVENTION

Taking into account the above explanations, it is the object of the present invention to provide inductive components having a compact structural design for mounting in small installation spaces while observing predefined safety standards, in particular without providing air paths and/or leakage paths and/or insulation distances that are shorter than the predefined paths/distances.

According to one aspect, the present invention provides an inductive component, comprising a magnetic core, an insulation body formed of an electrically insulating material and having the magnetic core accommodated therein, and a coil body having the at least one winding wound thereon. The insulation body comprises at least two insulation wall sections, which are connected to each other and which each face, at least partially, a respective side surface section of the magnetic core. The coil body comprises at least one contact element attached to a side surface section of the coil body and used for establishing an electric connection to the at least one winding, and a magnetic core accommodation in which the magnetic core accommodated in the insulation body is partially accommodated. A side surface section of the magnetic core, which faces the at least one contact element, is covered, at least partially, by an insulation wall section of the insulation body.

In view of the fact that the insulation body provided comprises at least two mechanically connected insulation wall sections, one of these insulation wall sections of the insulation body covering, at least partially, the magnetic-core side surface section facing the contact elements in the inductive component, sufficiently long air and leakage paths are guaranteed in a safe and reliable manner, independently of the dimensions of the inductive component.

According to an advantageous embodiment of this aspect, the side surface section of the magnetic core, which faces the contact elements, is fully covered by the insulation wall section. Leakage currents can be suppressed very efficiently in this way.

According to a further advantageous embodiment of this aspect, the insulation body and the coil body are mechanically connected by connection devices. In this way, the insulation body and the coil body can be provided separately, whereby a modularization of the inductive component and a retrofittable adaptation of air and leakage paths will be possible.

According to a more advantageous further development of this embodiment, the connection devices may comprise at least one first connection element arranged on the insulation body and at least one second connection element arranged on the coil body, the connection elements entering into mechanical engagement with each other. Through this kind of mechanical connection of the insulation body and the coil body, also reliable mounting of the insulation body and the coil body can easily be accomplished.

According to another more advantageous further development of this embodiment, the connection devices may be configured for coupling the insulation body and the coil body in a mechanically releasable manner. Leakage path extensions in the inductive component can thus be accomplished easily. Exchange and retrofitting of individual components will here be possible in case of need.

According to a further advantageous embodiment of this aspect, the insulation body is defined by at least three insulation wall sections, which are mechanically connected to one another such that the insulation body has a pot-like or cup-like shape including a recess in which the magnetic core is accommodated. An insulation body having this kind of structural design can easily be manufactured by injection molding techniques and can be produced in large quantities at a reasonable price. In addition, a pot-like or cup-like shape of the insulation body allows the core to be accommodated in the insulation body in a mechanically stable manner.

According to an advantageous further development of this embodiment, a depth of the recess may be larger than or equal to a height dimension of the magnetic core, the height dimension being defined with respect to the magnetic core along a direction along which the magnetic core is accommodated in the recess. This additionally allows to specify, according to a depth of the recess, an air and leakage path length along the entire height dimension of the magnetic core. As a result, very compact inductive components can be provided.

According to a further advantageous embodiment of this aspect, the insulation body further comprises at least one web section, which is formed on the insulation wall section and which faces the at least one contact element and projects outwards away from the insulation body along a normal direction of the insulation wall section. By means of the outwards projecting web sections, a mechanical stability of the insulation body is accomplished on the one hand, and, on the other hand, the web sections allow the air and leakage paths to be laterally enlarged.

According to an advantageous further development of this embodiment, the at least one web section may comprise a projecting portion projecting towards the coil body and inserted in a respective positioning opening formed in the coil body and arranged on a side on which at least one contact is arranged. In this way, a mechanically reproducible positioning of the insulation body on the coil body can be accomplished, which allows e.g. an advantage as regards a mechanical fitting of insulation bodies to coil bodies. Furthermore, exact positioning of the magnetic core on the coil body and thus relative to the winding provided above the coil body can be accomplished in this way.

According to another advantageous further development of this embodiment, at least two contact elements may be provided on a side surface section of the coil body, and two wire sections of the at least one winding may extend along the at least one web section on opposite sides of the latter to a respective one of the contact elements. Hence, a mechanical separation of the wire sections can be accomplished by means of the web section, so that the air and leakage paths between the two wire sections will be extended by means of the web section.

According to another advantageous embodiment of this first aspect, the inductive component further comprises at least one further contact element attached to a side surface section of the coil body, the side surface section being arranged on a coil body side located opposite the at least one contact element, a further magnetic core, and a further insulation body, the further insulation body comprising at least two insulation wall sections, which are connected to each other and which each face, at least partially, a respective side surface section of the further magnetic core, wherein the further insulation body is arranged on the coil body such that it is located opposite the insulation body, and the further magnetic core, which is accommodated in the further insulation body, is partially accommodated in the magnetic core accommodation, and wherein a side surface section of the further magnetic core, which faces the at least one further contact element, is covered, at least partially, by an insulation wall section of the further insulation body. In this way, an advantageous core design, composed of two individual magnetic cores, can be provided independently of dimensions of the inductive component, while satisfying predefined insulation distances. According to an advantageous further development of this embodiment, each of the two magnetic cores have an E-core configuration.

According to a further aspect of the present invention, a method of manufacturing an inductive component according to the above aspect is provided. The method comprises the steps of winding at least one winding onto the coil body and incorporating the magnetic core in the insulation body. The method further comprises the step of attaching the insulation body with the magnetic core accommodated therein to the wound coil body, the magnetic core being partially incorporated in the magnetic core accommodation of the coil body.

In the following, further advantages and features of the present invention will be described in more detail in connection with the figures enclosed, in which:

DETAILED DESCRIPTION OF THE INVENTION

Figure 1A:
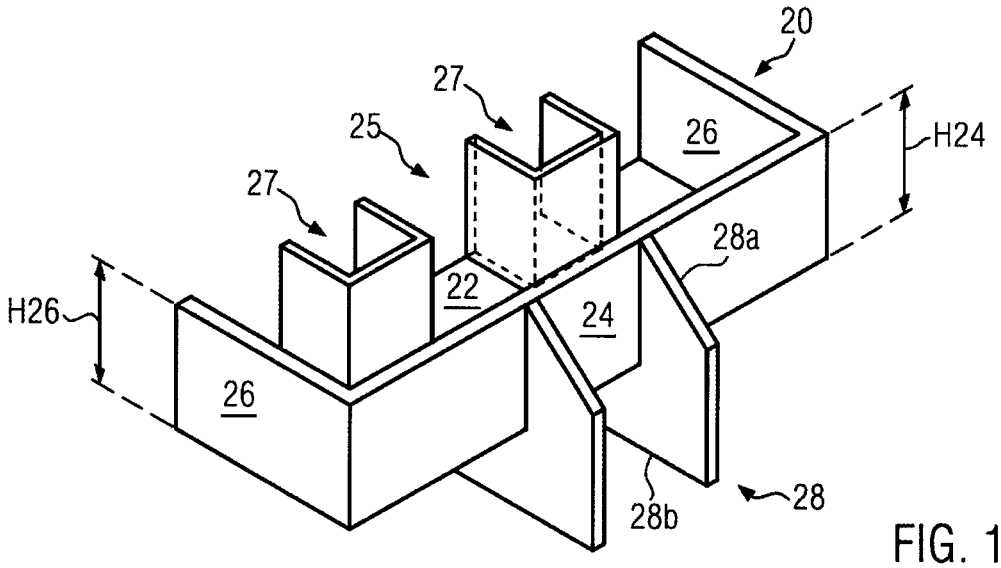
FIG. 1*a* shows schematically an insulation body according to first embodiments of the present invention in a perspective view.
Figure 1C:
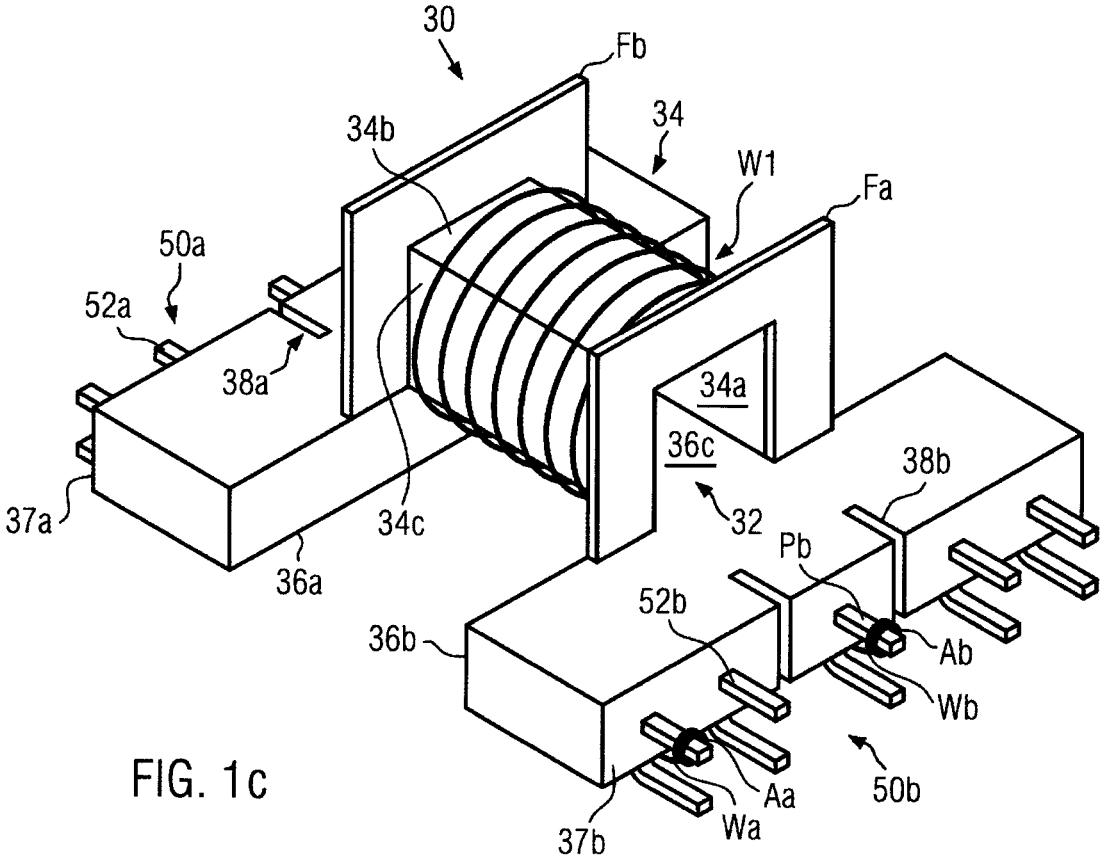
FIG. 1*c* shows schematically a wound coil body according to the first embodiments of the present invention in a perspective view.
Figure 1B:
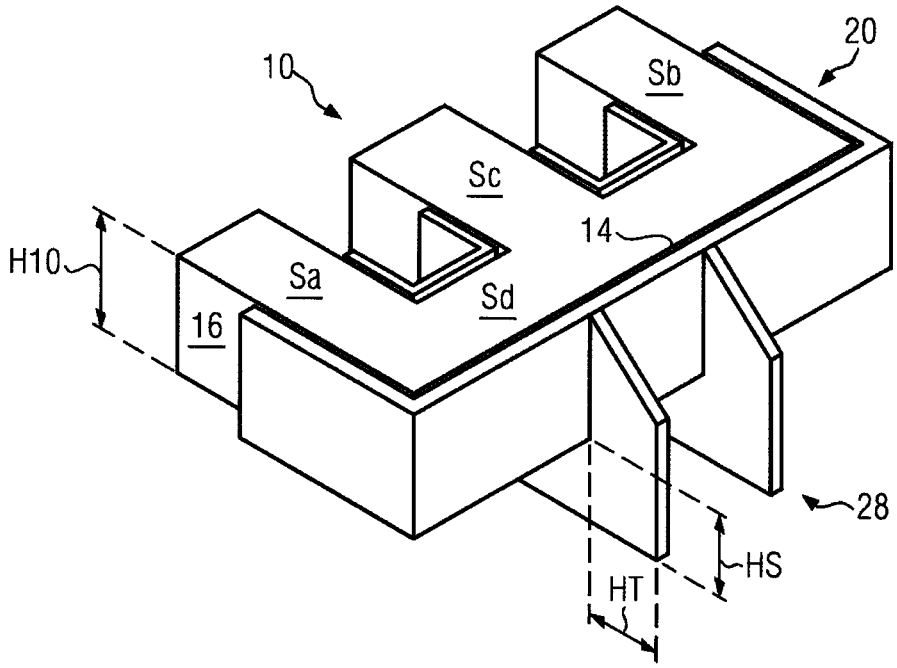
FIG. 1*b* shows schematically the insulation body according to FIG. 1*a*, together with a magnetic core accommodated therein, in a perspective view.
Figure 1D:
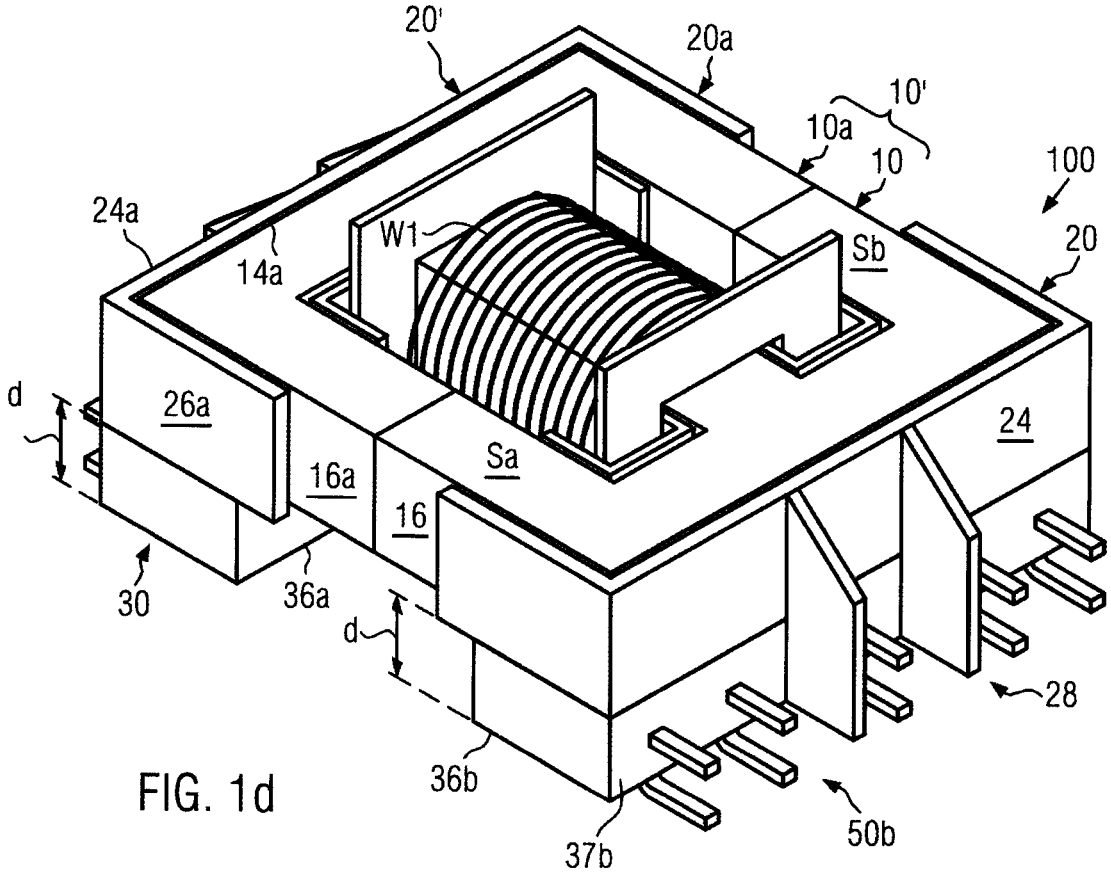
FIG. 1*d* shows schematically an inductive component according to the first embodiments of the present invention in a perspective view.

Making reference to FIGS. 1*a* to 1*d*, inductive components according to the present invention as disclosed in various first embodiments of the present invention will illustratively be described hereinafter. FIG. 1*d* shows here an inductive component 100 according to the first embodiments. In FIG. 1*a*, an insulation body 20 of the inductive component 100 of FIG. 1*d* is shown schematically in a perspective view. In FIG. 1*b*, the insulation body 20 with a magnetic core 10 is shown schematically in a perspective view, the magnetic core 10 being here accommodated in the insulation body 20. In FIG. 1*c*, a coil body 30 of the inductive component 100 of FIG. 1*d* with at least one winding W1 provided thereon is shown schematically in a perspective view.

As shown in FIG. 1*a*, the insulation body 20 is composed of insulation wall sections 22, 24 and 26, the insulation wall sections 22, 24 and 26 being mechanically connected to one another and defining a reception unit 25 configured and dimensioned in a suitable manner for accommodating the magnetic core 10 therein (cf. FIG. 1*b*). Furthermore, the insulation body 20 comprises U-shaped insulation wall sections 27, which, according to the shape of the magnetic core 10, are arranged on the bottom-side insulation wall section 22. These U-shaped insulation wall sections 27 are optional and may also be omitted. By means of the U-shaped insulation wall sections 27, which may alternatively also be only L-shaped or each formed by only one insulation wall section, the magnetic core 10 can mechanically be accommodated in the insulation body 20 in a stable manner, as will be described hereinafter in more detail with reference to FIG. 1*b*.

The shape of the bottom-side insulation wall section 22 may be adapted to the magnetic core 10. For example, the bottom-side insulation wall section 22 may have provided therein openings, which are surrounded by the U-shaped insulation wall sections 27 (in the representation according to FIG. 1*a*, these openings are not visible, but an opening is indicated in FIG. 1*a* by dashed lines with respect to one of the U-shaped insulation wall sections 27). This, however, does not represent a limitation of the bottom-side insulation wall section 22 and the latter may also be configured as a plate-shaped body having no openings.

The insulation wall sections 24, 26 project from the bottom-side insulation wall section 22 along a normal direction of the bottom-side insulation wall section 22, so that the reception unit 25 is defined by the bottom-side insulation wall section 22 and the insulation wall sections 24, 26 projecting therefrom. The insulation body 20 is open with respect to a side opposed to the bottom-side insulation wall section 22 and a side of the bottom-side insulation wall section 22 opposed to the insulation wall section 24.

This does not represent a limitation of the present invention, and a side of the insulation body 20 located opposite the bottom-side insulation wall section 22 may partially be covered by an insulation wall section (not shown) provided there. For example, an insulation wall section (not shown) having an area that is smaller than the base area of the bottom-side insulation wall section 22, e.g. an area that is at most half the size of this base area, opposite the bottom-side insulation wall section 22, may cover the U-shaped insulation wall section 24. This optional insulation wall section (not shown) may be provided as a "pick and place cap" which may be engageable by e.g. for a suction port on a conveying device (not shown) in an automated production process.

The bottom-side insulation wall section 22 is mechanically connected to the insulation wall sections 26 and the insulation wall section 24, the insulation wall section 24 being arranged on an edge of the bottom-side insulation wall section 22 and extending away therefrom in the normal direction with respect to the bottom-side insulation wall section, so that the insulation wall section 22 extends transversely to the direction of extension of the insulation wall sections 26 and is mechanically connected to the insulation wall sections 26.

According to the representation in FIG. 1*a*, the insulation wall sections 24 have a height H24 and the insulation wall sections 26 each have a height H26. Although this is not shown, the U-shaped insulation wall sections 27 may have the height H24 or the height H26. At least through the height H24, a depth of the reception unit 25 is determined according to the height dimension of the insulation wall section 24 (relative to the normal direction to the bottom-side insulation wall section 22).

Although the insulation wall sections 24, 26 are shown in the representation according to FIG. 1*a* as having the same height, this does not represent a limitation of the present invention, and the insulation wall sections 24, 26 and 27 may have different height dimensions, the height dimension H26 of the insulation wall sections 26 being here smaller than the height dimension H24 of the insulation wall 24.

The insulation body 20 further comprises two web sections 28, which are formed on the insulation wall section 24. The two web sections 28 shown do not represent a limitation of the present invention, and an arbitrary number of web sections 28 may be formed along the insulation wall section 24, e.g. only one web section (cf. FIG. 1*d*, the insulation body shown there having only one web section 28) or more than two web sections. Alternatively, the web section 28 may also be omitted.

The web sections 28 have a projecting portion 28*a* which extends in the normal direction of the insulation wall section 24 and thus projects in the normal direction to the insulation wall section 24 from the latter. The web sections 28 may additionally comprise a projecting portion 28*b*, which extends along the normal direction of the bottom-side insulation wall section 22 and which projects downwards from the insulation body 20 along an underside of the bottom-side insulation wall section 22.

With respect to FIG. 1*b*, a condition is now shown, in which the magnetic core 10 is accommodated in the insulation body 20. According to the representation shown in FIG. 1*b*, the magnetic core 10 is configured in the form of an E-shaped magnetic core 10 having two side legs Sa, Sb and an intermediate middle leg Sc, which are connected by a transverse yoke Sd oriented transversely to the side legs Sa, Sb and the middle leg Sc. According to the representation shown, the magnetic core 10 has a height H10, which is defined along a direction perpendicular to a direction of extension of the transverse yoke Sd and perpendicular to the directions of extension of the side legs Sa, Sb and the middle leg Sc. This does not represent a limitation of the present invention, and the magnetic core 10 may alternatively be provided as a C- or I-shaped magnetic core (not shown). In this case, the bottom-side insulation wall section of the insulation body 20 must be adapted to this core shape and the U-shaped insulation wall sections 27 are not to be provided.

As can be seen from FIGS. 1*a* and 1*b* and as has been described hereinbefore, the insulation body 20 is configured in accordance with the magnetic core 10, so that the magnetic core 10 will be accommodated in the reception unit 25 of the insulation body 20. In particular, the height dimensions (corresponding to the depth of the reception unit 25) H24, H26 are adapted to the height dimension H10 of the magnetic core 10 such that H10≤H24 and H10≤H26. According to special illustrative embodiments, the following examples are here provided, (a) H10=H24=H26, (b) H10=H26<H24, (c) H10<H26=H24 and (d) H10<H26<H24.

According to the above described height dimensions of the magnetic core 10 and the above described depth of the reception unit 25, it is ensured that a side surface 14 of the transverse yoke Sd of the magnetic core 10, which, in the magnetic core condition shown in FIG. 1*b*, in which the magnetic core 10 is accommodated in the insulation body 20, faces the insulation wall section 24, the side surface section 14 of the magnetic core 10 along the height dimension H10 of the magnetic core 10 being covered by the insulation wall section 24 (H10≤H24). This shall not exclude that the side surface section 14 of the magnetic core 10 is covered only partially by the insulation wall section 24, when the insulation wall section 24 has formed therein openings (not shown), which partially expose the side surface section 14 of the magnetic core 10, e.g. in the event that the insulation wall section 24 is formed by a plurality of subsections that project from the bottom-side insulation wall section 22 along the normal direction of the latter.

Making still reference to FIG. 1*b*, embodiments of the web sections 28 will now be described in more detail. The projecting portion 28*a* of one of the web sections 28, which projects along the normal direction of the insulation wall section 24, projects by a projection height HT from the insulation wall section 24. In addition, at least one of the web sections 28 may extend downwards away from the underside of the insulation body 20 by the projecting portion 28*b* with a projection height HS from the bottom-side insulation wall section 22 along the normal direction of the bottom-side insulation wall section 22. In this way, at least one of the web sections 28 may define an L-shaped web configuration formed on the insulation wall sections 22, 24. Alternatively to the representation in FIGS. 1*a* and 1*b*, at least one web section of the web sections 28 may be defined by only one web projecting from the insulation wall section 24 (in this case HS=0). A function of the web sections 28 will be described in more detail hereinafter at the appropriate point with respect to FIGS. 1*c* and 1*d*.

Making reference to FIG. 1*c*, the coil body 30 is shown, which has at least one winding W1 wound thereon. By way of example, at least a primary winding and a secondary winding are provided in the case of a transformer (primary and secondary windings are not shown specifically in the schematic representations according to FIGS. 1*c* and 1*d*). Alternatively, only one winding may be provided by way of example.

The coil body 30 shown in FIGS. 1*c* and 1*d* may be a coil body which can be wound easily and in particular automatically and which is configured for SMD mounting, as illustrated schematically in FIGS. 1*d* and 1*c* by contact elements in the form of U-shaped contact pins 50*a* and 50*b*. However, this does not represent a limitation of the present invention, since instead of the SMD design of the coil body 30, the latter may alternatively be configured as a THT coil body for through-hole mounting. The contact elements may here be provided as L-shaped contact elements instead of the U-shaped contact pins 50*a*, 50*b* shown.

According to the representation shown in FIG. 1*c*, the coil body 30 comprises a core reception unit 32, above which at least one winding chamber 34 is provided for accommodating the at least one winding W1. At opposed ends of the core reception unit 32 of the coil body 30, contact strips 36*a* and 36*b* are arranged, which extend transversely to a longitudinal direction of the magnetic core accommodation 32. Contact elements corresponding to the contact pins 50*a*, 50*b* are accommodated in the contact strips 36*a*, 36*b*, so that a series of contact pins 52*a*, 52*b* project from end faces 37*a*, 37*b* of the contact strips 36*a*, 36*b* along a direction of extension of the magnetic core accommodation 32. The contact pins 52*a*, 52*b* have wrap connections attached thereto, as illustrated schematically in FIG. 1*c* on the basis of some connections Aa, Ab of wire end sections Wa, Wb of the winding W1. The wire end sections Wa, Wb may extend to the contact pins 52*b* below the contact strip 36*b* of the coil body 30 and may be electrically connected to the contact pins 52*b*, so as to electrically connect the winding W1 to the contact pins 52*b*, as illustrated e.g. on the basis of a contact pin Pb in FIG. 1*c*. The connection Ab of the wire end section Wb is here mechanically and electrically connected to the contact pin Pb, e.g. (without restriction) by wrapping the contact pin Pb with the wire end section Wb or by soldering the wire end section Wb to the contact pin Pb or the like, thus forming the connection Ab. In illustrative embodiments, at least one contact element, which is represented by at least one contact pin 50*a*, is attached to the further side surface section 37*a* of the coil body 30, said further side surface section 37*a* being located opposite to at least one other contact element represented by at least one of the contact pins 50*b*. The side surface sections 37*a* and 37*b* are formed on opposed sides of the coil body 30.

According to the representation in FIG. 1*c*, the winding chamber 34 of the coil body 30 may be defined by wall sections 34*a* and 34*c*, which project from a connecting section 36*c* along a normal direction with respect to the connecting section 36*c*, the connecting section 36*c* connecting the contact strips 36*a* and 36*b* mechanically to each other. The contact strips 36*a*, 36*b* and the connecting section 36*c* may here be formed integrally with one another. According to the embodiment shown, the contact strips 36*a*, 36*b* and the connecting section 36*c* are formed in the form of the letter H.

Furthermore, a wall section 34*b* is formed opposite the connection section 36*c*, the wall section 34*b* connecting the winding chamber sections 34*a* and 34*c* with each other. Thus, the magnetic core accommodation 32 is enclosed by the winding chamber sections 34*a*, 34*c*, the connecting sections 36*c* and the wall section 34*b* located opposite to the latter.

In accordance with some illustrative embodiments, as shown explicitly in FIG. 1*c*, flange-like projections Fa, Fb may be formed at opposed end sections of the magnetic core accommodation 32, the flange-like projections Fa, Fb delimiting the winding chamber along the magnetic core accommodation 32. Thus, the coil body 30, having wound thereon at least the winding W1 in the winding chamber 34, provides a coil between the contact strips 36*a*, 36*b*. Additionally or alternatively, partitions (not shown) may be provided in the winding chamber 34 so as to separate individual winding sections of the at least one winding W1 from one another.

Making reference to FIG. 1*c*, the contact strip 36*a* has formed therein at least one opening 38*a*, e.g. in the form of a slot. The at least one opening 38*a* may extend through the contact strip 36*a*, at least partially, along a direction parallel to the contact pins 52*a*. In addition, the at least one opening 38*a* may extend through the contact strip 36*a*, at least partially, along the entire thickness of the latter (cf. the thickness d of the contact strips in the representation of FIG. 1*d*).

Additionally or alternatively, the contact strip 36*b* may have formed therein at least one opening 38*b* (e.g. two, as illustratively shown in FIG. 1*c*), e.g. in the form of a slot. The opening 38*b* may extend partially through the contact strip 36*b* along a direction parallel to the contact pins 52*b*. In addition, the at least one opening 38*b* may extend through the contact strip 36*b*, at least partially, along the entire thickness of the latter (cf. the thickness d of the contact strips in the representation of FIG. 1*d*).

According to some illustrative embodiments, the openings 38*a* and 38*b* in the respective contact strips 36*a* and 36*b* may be formed between respective neighbouring contact elements, e.g. the contact pins 50*a* and 50*b*, (alternatively at least one opening may also be formed in only one contact strip). For example, the contact elements, e.g. the contact pins 50*a* and 50*b* in the respective strip 36*a* and 36*b*, may also be subdivided into subgroups of contact elements by the respective openings 38*a* and 38*b*, the degree of subdivision depending on the respective case of use. The number of openings formed in one of the contact strips 36*a*, 36*b* may be different from or equal to the number of openings formed in the other of the contact strips 36*a*, 36*b*. In any case, the number of openings is related to the number of projecting portions 28*b* formed on the insulation body 20 (cf. FIGS. 1*a* and 1*b*).

In an illustrative example of the first embodiment, a height HS of a projecting portion 28*b* is smaller than or equal to the thickness (cf. d in FIG. 1*d*) of a contact strip. The insulation body 20 can be positioned and stabilized on the coil body 30 in this way. For example, the insulation body 20 can be mounted permanently and fixedly on the coil body 30 by means of bonding by introducing an adhesive into at least one opening. Alternatively, the insulation body 20 may be connected releasably or permanently to the coil body 30 by means of a locking mechanism (not shown). In this case, locking projections or locking hooks (not shown), which are formed on at least one web section 28 of the insulation body 20, engage complementary recesses (not shown) provided in at least one opening 38 or, vice versa (locking projections/hooks provided in at least one opening and engaging a recess provided in at least one web section). This allows fixed positioning of the insulation body 20 on the coil body 30 and thus of the magnetic core 10 with respect to the at least one winding W1 over the coil body 30.

According to a concrete illustrative structural design of the first embodiment, the height HS of at least one projecting portion 28*b* is greater than a thickness (cf. d in FIG. 1*d*) of the contact strips 36*a*, 36*b*. In this case, the at least one projecting portion 28*b* projects from the underside of the associated contact strip 36*a*, 36*b* and thus allows an underside formation of a labyrinth for extending the leakage path and the air path between the contact pins 50*a*, 50*b* on the underside of the respective contact strip 36*a*, 36*b*. This labyrinth structure (not shown) may cooperate with an additional labyrinth structure (not shown) provided on the underside of at least one of the contact strips 36*a*, 36*b*. For example, guide grooves (not shown) may be formed on the underside of at least one of the contact strips 36*a*, 36*b*, in order to guide the wire sections Wa, Wb of the winding W1 on the underside to respective contact pins 52*b*. This may apply in a corresponding manner to the contact strip 36*a*.

Making reference to FIG. 1*d*, the inductive component 100 will now be described in more detail. According to the embodiment shown, the inductive component 100 additionally comprises a further magnetic core 10*a* and a further insulation body 20*a*. The insulation body 20*a* comprises an insulation wall section 24*a* and an insulation wall section which is not visible in the representation of FIG. 1*d*, said insulation wall section being realized in accordance with the insulation wall section 22 of the insulation body 20 and being disposed relative to the coil body 30 and being connected to the insulation wall section 24*a*. Furthermore, the insulation body 20*a* may comprise at least one additional insulation wall section 26*a*, which is connected to the insulation wall sections 24*a* and the insulation wall section that is not shown (which is provided in the insulation body 20*a* similar to the insulation wall section 22 of the insulation body 20). Independently of their number and structural design, each of the insulation wall sections faces, at least partially, a side surface section of the magnetic core 10*a* (for example, the insulation wall section 24*a* faces a side surface section 14*a* of the magnetic core 10*a* and the insulation wall section 26*a* faces a side surface section 16*a* of the magnetic core).

According to illustrative embodiments, the insulation body 20*a* is arranged on the coil body 30 such that the insulation body 20*a* is located opposite the insulation body 20 and the magnetic core 10*a* accommodated in the insulation body 20*a* is partially accommodated in the magnetic core reception unit 32 of the coil body 30. A side surface section 14*a* of the magnetic core 10*a*, which faces the at least one further contact element 50*a*, is at least partially covered by the insulation wall portion 24*a* of the insulation body 20*a*.

From an alternative point of view, the inductive component 100 may be regarded as having a modular magnetic core 10'. This modular magnetic core 10' may be formed according to a double-E-core configuration from the E-shaped magnetic cores 10, 10*a*, as shown. This does not represent a limitation and, instead of two E-cores, also two C-cores, one E-core and one C-core, one E-core and one I-core, and one C-core and one I-core may be combined in the inductive component 100.

From the point of view of a modular magnetic core 10', the individual magnetic cores 10, 10*a* represent individual core segments of the modular magnetic core 10'.

According to the representation shown in FIG. 1*d*, the magnetic cores 10, 10*a* (or core segments 10, 10*a* in the modular magnetic core 10') are accommodated in the respective E-shaped insulation bodies 20, 20*a*. The representation in FIG. 1*d* with respect to the separate insulation bodies 20, 20*a* should here be considered to be not restrictive. For example, the insulation bodies 20, 20*a* may be configured such that they are connected by at least one insulation wall section. The insulation bodies 20, 20*a* may, for example, be connected to each other by a common insulation wall section corresponding to the insulation wall section 26 or by a connected bottom-side insulation wall section (in the form of an "H") or may be formed as an integral insulation body 20'.

According to the representation in FIG. 1*d*, each of the insulating bodies 20, 20*a* is connected to a respective one of the contact strips 36*a*, 36*b*, as shown in FIG. 1*d*. In particular in the event that the bottom-side insulation wall section 22 has openings provided therein, which are provided through the (optional) U-shaped insulation wall sections 27 (cf. FIG. 1*a*), each of the insulation bodies 20, 20*a* is inserted at a side of the magnetic core accommodation (cf. 32 in FIG. 1*c*) of the coil body 30. In this way, a middle leg of each of the E-shaped magnetic cores 10, 10*a* is inserted into the magnetic core accommodation 32 of the coil body 30, which is shown in FIG. 1*c*.

Although only one web section 28 is shown in FIG. 1*d*, this does not represent a restriction and, alternatively, more than one web section 28, e.g. two web sections 28, may be provided, as shown in FIGS. 1*a* and 1*b*.

Although the modular or integral insulation body 20' in the representation of FIG. 1*d* is shown as being composed of two individual insulation bodies 20, 20*a*, which are arranged on respective contact strips 36*a*, 36*b* of the coil body 30, this does not represent a limitation of the present invention and, instead, only a single insulation body 20 or 20*a* may be provided on a respective one of the contact strips 36*a*, 36*b* of the coil body 30 in FIG. 1*d*.

Making reference to FIG. 1*b*, a function of the web sections 28 will now be described in more detail. As described above with reference to FIG. 1*b*, the web sections 28 may project here by the height HT from the insulation wall section 24 of the body element 20 along a normal direction of the bottom-side insulation wall section, in the case of a few illustrative embodiments. Thus, the leakage path between two of the contact pins 50*b*, between which the web section 28 is arranged, can be extended, depending on the height HT. If, for example, the height HT of the web section, which is arranged between two contact pins 50*b*, exceeds a length of the contact pins 50*b* by which the contact pins 50*b* project from the end face 37*b* of the contact strip 36*b*, an extension of the air path between these contact elements can be provided.

Referring still to FIG. 1*d*, the insulation wall section 24 covers a side surface section of the magnetic core 10, which faces the contact pins 50*b* and has been described in connection with FIG. 1*d* as side surface section 14. In this way, the side surface section 14 of the magnetic core 10, which faces the contact pins 50*b*, is covered by the insulation wall section 24, and an extension of path between the contact pins 50*b* and the magnetic core 10 is here provided according to a height of the insulation wall 24, as has been described above with reference to the heights H24 and H26. This also applies to an insulation wall section 24*a* of the insulation body 20*a* on the side of the oppositely located contact strip 36*a*, the side surface section 14*a* of the magnetic core 10*a* facing the contact pins 50*a* being covered by the insulation wall section 24*a*, whereby an extension of path between the contact pins 50*a* and the magnetic core 10*a* is provided according to a height of the insulation wall 24*a*.

It follows that the respective air and leakage paths required between the contact pins 50*a*, 50*b* of the inductive component 100 and the magnetic cores 10, 10*a* are determined through the height of the insulation bodies 20, 20*a*. Advantageously, the leakage path extension takes place independently of a base area of the inductive component 100, in particular a bottom-side area of the coil body 30. This means, in turn, that the inductive component 100 can be provided in a very compact manner while observing the necessary air and leakage paths.

The inductive component 100 according to the first embodiment can be manufactured according to the following method steps. The magnetic cores 10 and 10*a* (or the magnetic core segments of the modular magnetic core 10') are incorporated into the respective insulation bodies 20, 20*a*. Optionally, each of the magnetic cores 10, 10*a* may adhesively be secured in position in the respective insulation body 20, 20*a*, or may be mounted in the respective insulation bodies 20 and 20*a* in some other way, e.g. through structures according to locking projections or locking hooks (not shown), which are provided on the insulation body 20, 20*a* in question, or by attaching a top insulation cover to the respective insulation bodies 20, 20*a* after incorporation of the magnetic cores 10, 10*a*. In this way, the respective individual magnetic cores 10, 10*a* are incorporated into the individual insulation bodies 20, 20*a* and can be provided separately at this time.

Independently of the provision of the magnetic cores 10, 10*a* in the insulation bodies 20, 20*a*, the coil body 30 has wound thereon at least one winding W1, e.g. in an automatic winding process.

Subsequently, each of the insulation bodies 20, 20*a* including the respective magnetic cores 10, 10*a* are attached to a respective one of the contact strips 36*a*, 36*b* in the way described above. To this end, middle legs (cf. Sc in FIG. 1*b*) of the magnetic cores 10, 10*a* are inserted into the core accommodation 32 of the coil body 30 from opposite sides of the core accommodation 32.

Optionally, the individual magnetic cores 10, 10*a* may be fixed to each other by adhesive bonding on end faces of the magnetic cores 10, 10*a*, which are in contact with one another, the magnetic core 10' being provided as a unit. Additionally or alternatively, the individual insulation bodies 20, 20*a* may be attached to the coil body 30 by means of adhesive bonding and the like.

The inductive component 100 shown in FIG. 1*d* may be produced by a method comprising the steps of winding the at least one winding W1 onto the coil body 30, incorporating at least one of the magnetic cores 10, 10*a* into the insulation body 20, 20*a* associated therewith (e.g. only the magnetic core 10 in FIG. 1*b* may be inserted into the insulation body 20 shown there, the other magnetic core 10*a* may be attached to the coil body without the insulation body 20*a*, so that the use of the insulation body 20*a* is dispensed with in the inductive component 100), and attaching the insulation body or the insulation bodies 20, 20*a* with the magnetic core 10, 10*a* accommodated therein to the wound coil body 30, the magnetic cores 10, 10*a* being partially received in the magnetic core accommodation 32 of the coil body 30. Winding the coil body 30 may take place independently of the incorporation of the magnetic cores 10, 10*a* in the insulation body or insulation bodies 20, 20*a*, e.g. separated in time therefrom or simultaneously therewith. In addition, the magnetic cores 10, 10*a* may be incorporated into the insulation bodies 20, 20*a* by accommodating the magnetic core 10 in the insulation body 20 and the magnetic core 10*a* in the insulation body 20*a*. However, as pointed out above, an alternative possibility is that only one magnetic core (e.g. the magnetic core 10 or the magnetic core 10*a*) is incorporated into one of the insulation bodies 20, 20*a* before this insulation body is attached to the coil body 30 and the other of the magnetic cores 10, 10*a* is attached directly to the coil body 30. In this way, an automated manufacturing process for manufacturing the inductive component 100 can be provided.

In summary, first embodiments of the inductive component 100 are described with respect to FIGS. 1*a* to 1*d*, the inductive component 100 comprising the magnetic core 10, the insulation body 20, which is formed of an electrically insulating material and in which the magnetic core 10 is accommodated, the insulation body 20 including at least the two connected insulation wall sections 22, 24 (optionally with at least one of the insulation wall sections 26), which each face, at least partially, a respective one of the side surface sections 14, 16 of the magnetic core 10, the at least one winding W1, and the coil body 30, which has the at least one winding W1 wound thereon and which comprises at least the contact element, e.g. at least one contact pin 50*b*, attached to the side surface section 37*b* of the coil body 30 for establishing an electric connection to the at least one winding W1, and the magnetic core accommodation 32, in which the magnetic core 10 accommodated in the insulation body 20 is partially accommodated, the side surface section 14 of the magnetic core 10, which faces the at least one contact element, being covered, at least partially, by the insulation wall section 24 of the insulation body 20.

The side surface section 14 of the magnetic core 10, which faces the at least one contact element 50*b*, may here be fully covered by the insulation wall section 24.

Furthermore, the insulation body 20 and the coil body 30 may be mechanically connected by the connection devices 28, 38. The connection devices 28, 38 may here comprise at least one first connection element 28 arranged on the insulation body 20 and at least one second connection element 38 arranged on the coil body 30, which enter into mechanical engagement with one another. Additionally or alternatively, the connection devices 28, 38 may be configured for coupling the insulation body 20 and the coil body 30 in a mechanically releasable manner.

In addition, the insulation body 20 may be formed by at least the three insulation wall sections 22, 24, 26, which are connected to one another such that the insulation body 20 has a pot-like or cup-like shape including the recess 25 in which the magnetic core 10 is accommodated. A depth of the recess 25 may here be larger than or equal to the height dimension H10 of the magnetic core 10, the height dimension being defined with respect to the magnetic core 10 along a direction along which the magnetic core 10 is accommodated in the recess 25.

Furthermore, the insulation body 20 may also comprise at least one of the web sections 28, which is formed on the insulation wall section 24 and which faces the at least one contact element 50*b* and projects outwards away from the insulation body 20 along a normal direction of the insulation wall section 24. This at least one web section 28 may comprise the projecting portion 28*b* projecting towards the coil body 30 and inserted in the respective positioning opening 38 formed in the coil body 30 and arranged on the coil body side on which the at least one contact element 50*b* is arranged. In addition, the contact elements 50*b* may be provided in a number of two contact pins on the side surface section 37*b* of the coil body 30 and at least the two wire end sections Wa and Wb of the at least one winding W1 may extend along the at least one web section 28 on opposite sides of the latter to a respective one of the contact elements 50*b*.

Furthermore, the inductive component 100 may at least additionally comprise one of the contact elements 50*a*, which is arranged on the side surface section 37*a* of the coil body 30 disposed on the coil body side located opposite the contact element 50*b*, the further magnetic core 10*a* and the further insulation body 20*a*, the further insulation body 20*a* comprising at least the insulation wall section 24*a*, which faces the side surface section 14*a* of the further magnetic core 10*a* at least partially, and a further insulation wall section, which is connected thereto and which faces, at least partially, a further side surface section (a side surface section connected to the side surface section 14*a*) of the further magnetic core 10*a*, the further insulation body 20*a* being arranged on the coil body 30 such that it is located opposite the insulation body 20 and the further magnetic core 10*a*, which is accommodated in the further insulation body 20, is partially accommodated in the magnetic core accommodation 32. The side surface section 14*a* of the further magnetic core 10*a*, which faces the at least one further contact element 50*a*, may be covered, at least partially, by the insulation wall section 24*a* of the further insulation body 20*a*, and the magnetic cores 10, 10*a* may each have an E-core configuration.

Making reference to FIGS. 2*a* and 2*b*, an inductive component 200 (cf. FIG. 2*b*) according to a second embodiment will now be described. The inductive component 200 according to the second embodiment differs from the inductive component 100 according to the first embodiment, which has been described hereinbefore with respect to FIGS. 1*a* to 1*d*, through an alternative structural design of the insulation body, as shown on the basis of an insulation body 220 in FIGS. 2*a* and 2*b* and as will be described hereinafter. A coil body 230 of the inductive component 200, as shown in FIG. 2*b*, differs from the coil body 30 according to the representations in FIGS. 1*c* and 1*d* insofar as a connection mechanism between the insulation body 220 and the coil body 230 is realized by means of a locking mechanism 240. In this case, a locking hook 242, which is formed on the insulation body 220, engages a recess 244 of the coil body 230 during mounting of the insulation body 220 on the coil body 230. The recess 244 is formed on a contact strip 236*b* of the coil body 230. Although in FIG. 2*a* only one locking hook 242 is shown, a further locking hook (not shown) may be provided on the same side of the insulation body 220 opposite the recess 244. Accordingly, a recess (not shown) would be formed in the contact strip 236*b* opposite the recess 244.

Apart from this, the structural design of the coil body 230 corresponds to that of the coil body 30 and comprises in particular contact strips 236*a*, 236*b*, which are connected by a connection area (not shown) corresponding to the connection section 360. Furthermore, contact pins 250*a*, 250*b* are formed in the respective end faces 237*a*, 237*b* of the respective contact strips 236*a*, 236*b*.

The insulation body 220 comprises a bottom-side insulation wall section 222 and insulation wall sections 224 and 226 extending away from the bottom-side insulation wall section 222 along a normal direction of the latter. Furthermore, the bottom-side insulation wall section 222 has formed therein U-shaped insulation wall sections 227 corresponding to the U-shaped insulation wall sections 27 in the representation according to FIG. 1*a*. Above the insulation wall sections 227 an optional "pick and place surface" 229 may be provided, as shown in FIG. 2*a*, which extends as a planar cap above the U-shaped insulation wall sections 227 and which may be used as a point of application for a suction port (not shown) in an automated fabrication and placement process.

The insulation body 220 has formed therein a recess 225, which is laterally surrounded by the insulation wall sections 224 and 226. A depth of the recess 225 is defined by an insulation wall section height H220, as has been stated in a corresponding manner in connection with FIG. 1*a* with respect to the heights H24 and H26. In particular, the insulation wall sections 226 and 224 may have different heights, although they are shown with equal heights in the representation of FIG. 2*a*.

The recess 225 in FIG. 2*a* has inserted therein a magnetic core 210, e.g. by inserting a core segment 210*a* of an E-core and by subsequently pushing in a core segment 210*b* into the insulation body 220 from outside (cf. the magnetic core 210 in FIG. 2*b*). A height H210 of the magnetic core 210 may be substantially smaller than or equal to a depth of the recess: H220≤H210. The magnetic core 210 has side surface sections 214, 216.

According to some illustrative embodiments, the magnetic core 210 may be a magnetic core 210 of a modular type, which is composed of individual magnetic cores 210*a*, 210*b*. The magnetic cores 210*a*, 210*b* may by fixed to each other by adhesive bonding, so as to provide the magnetic core 210 in an integral form when the inductive component 200 has been provided.

The insulation body 220 can be used in the event that, in the inductive component 200, only one contact strip 236*a* has provided thereon contact elements 250*a*, which are provided for applying a high voltage thereto (high voltage terminals are to be provided on one contact strip), whereas the other contact strip 236*b* has provided thereon contact elements 250*b*, which are intended to have applied thereto a low voltage potential. Accordingly, an advantageous air and leakage path extension to the magnetic core 210 and the winding W2 over the coil body 230 is provided by means of the insulation body 220 on the high voltage carrying side of the inductive component 200, in particular on the contact strip 236*a* of the high-voltage contact elements 250*a*, through the insulation wall section 224 facing the high-voltage terminals.

Figure 2A:
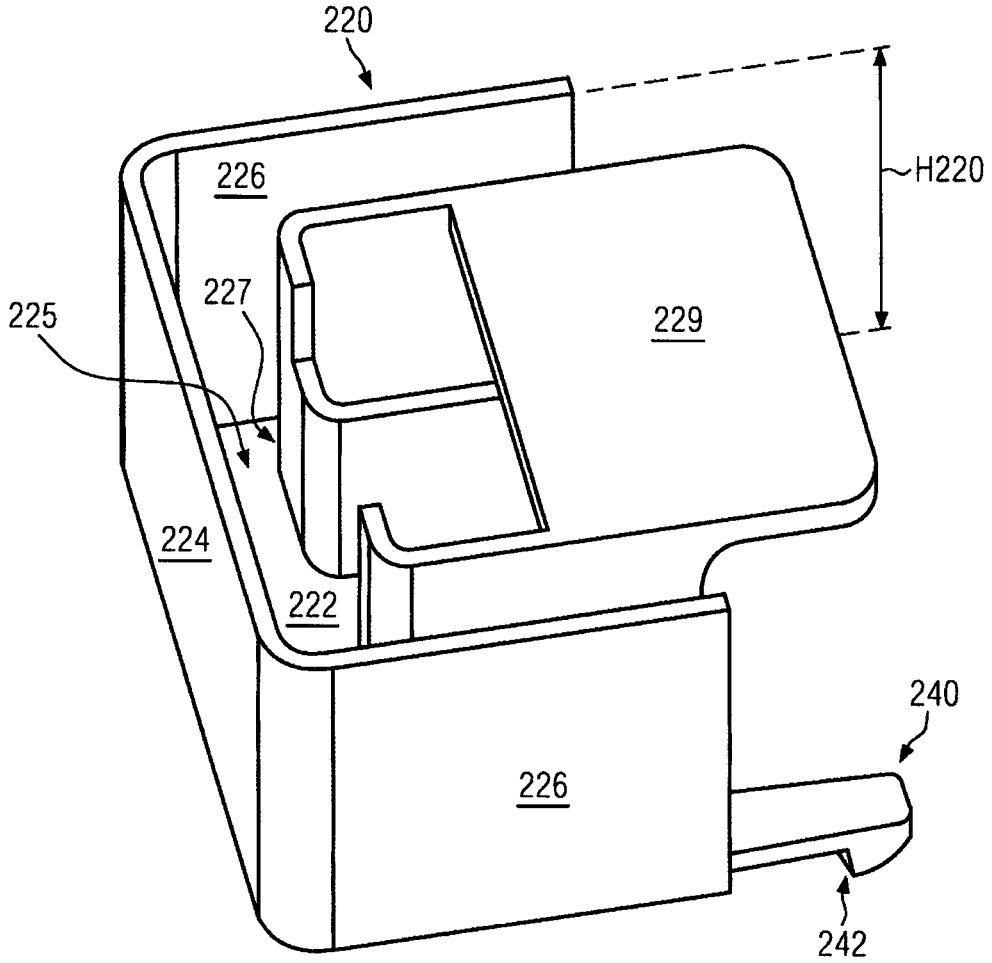
FIG. 2*a* shows schematically an insulation body according to second embodiments of the present invention in a perspective view.
Figure 2B:
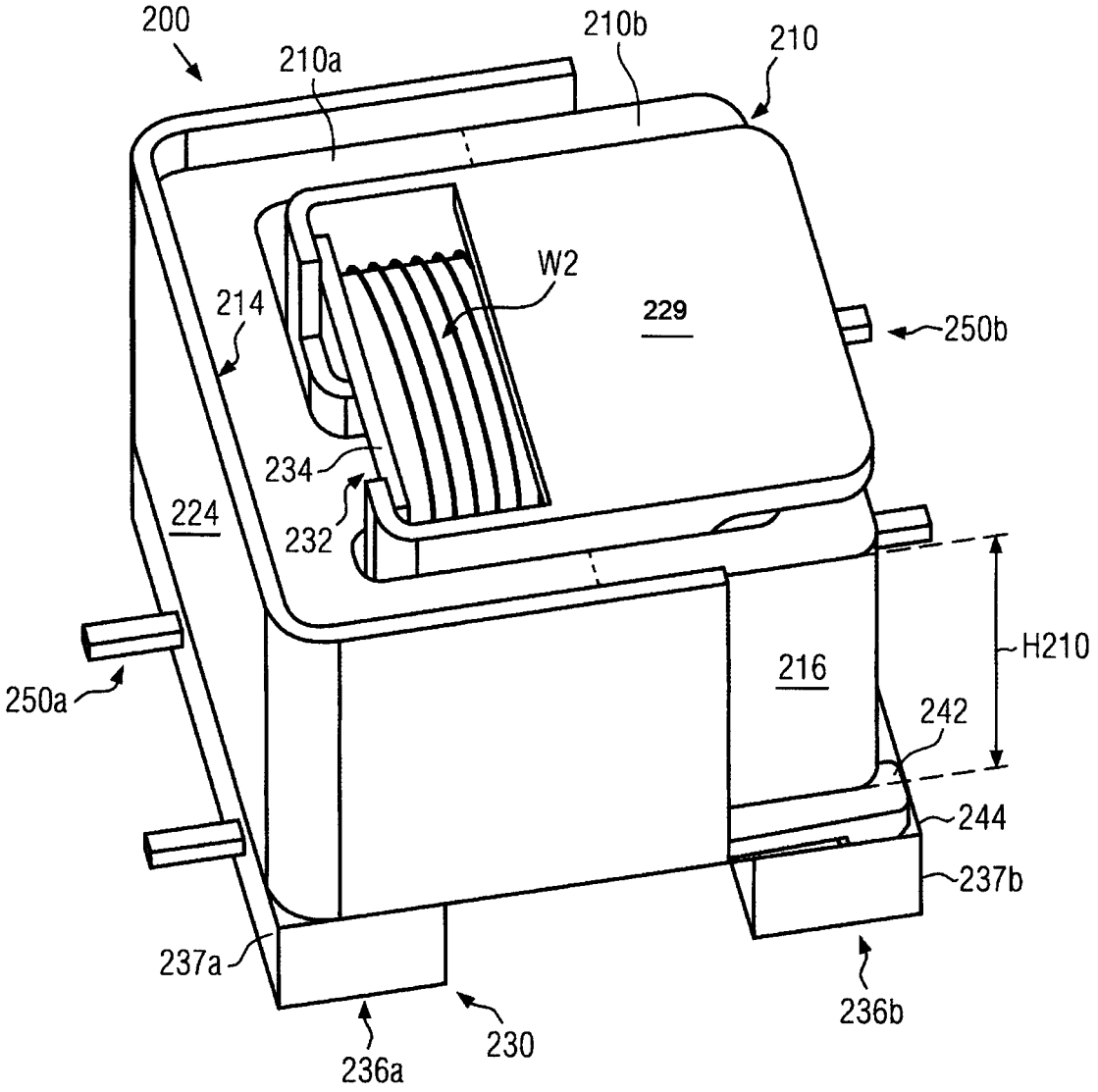
FIG. 2*b* shows schematically an inductive component, which comprises the insulation body shown in FIG. 2*a*, in a perspective view.

The mounting of the insulation body 220 on the coil body 230 according to the representation in FIGS. 2*a* and 2*b* is only illustrative and not limiting, since, instead of the connection devices 240 and/or in addition to the latter, web sections (not shown), which correspond to the web sections 28 according to the first embodiment, and respective slots in the coil body may be provided.

The inductive component 200 shown in FIG. 2*b* can be produced by a method comprising the steps of winding the at least one winding W2 onto the coil body 230, incorporating the magnetic core 210 into the insulation body 220, and attaching the insulation body 220 with the magnetic core 210 accommodated therein to the wound coil body 230, the magnetic core 210 being partially received in the magnetic core accommodation 232 of the coil body 230. Winding the coil body 230 may here take place independently of the incorporation of the magnetic core 210 in the insulation body 220, e.g. separated in time therefrom or simultaneously therewith. In addition, the magnetic core 210 may be incorporated into the insulation body 220 by accommodating the core segment 210*a* in the insulation body 220 and by inserting the core segment 210*b* subsequently into the insulation body 220. In this way, an automated manufacturing process for manufacturing the inductive component 200 can be provided.

In summary, FIGS. 2*a* and 2*b* provide the inductive component 200, which, according to the second embodiment described, comprises the magnetic core 210, the insulation body 220, which is formed of an electrically insulating material and in which the magnetic core 210 is accommodated, the insulation body 220 including at least the two connected insulation wall sections 222, 224, which each face, at least partially, a respective one of the side surface sections 214, 216 of the magnetic core 210, the at least one winding W2, and the coil body, which has the at least one winding W2 wound thereon and which comprises at least one contact element in the form of a contact pin 250*a* attached to the side surface section 237*a* of the coil body 230 for establishing an electric connection to the at least one winding W2, and the magnetic core accommodation 232, in which the magnetic core 210 accommodated in the insulation body 220 is partially accommodated, the side surface section 214 of the magnetic core 210, which faces the at least one contact element 250*a*, being covered, at least partially, by one of the insulation wall sections 224 of the insulation body 220.

In addition, the side surface section 214 of the magnetic core 210, which faces the at least one contact element 250*a*, may here be fully covered by the insulation wall section 224.

Furthermore, the insulation body 220 and the coil body 230 may be mechanically connected by the connection devices 240. The connection devices 240 may here comprise at least the first connection element 242 arranged on the insulation body 220 and at least the second connection element 244 arranged on the coil body 230, which enter into mechanical engagement with one another. The connection devices 240 may be configured for coupling the insulation body 220 and the coil body 230 in a mechanically releasable manner.

In addition, the insulation body 220 may be formed by at least three insulation wall sections, which are connected to one another, so that the insulation body 220 has a pot-like or cup-like shape including the recess 225 in which the magnetic core 210 is accommodated.

Furthermore, the depth of the recess 225 may here be larger than or equal to the height dimension H210 of the magnetic core 210, the height dimension being defined with respect to the magnetic core 210 along the direction along which the magnetic core 210 is accommodated in the recess 225.

What is claimed is:

1. An inductive component, comprising:

a magnetic core, an insulation body formed of an electrically insulating material and having the magnetic core accommodated therein, wherein the insulation body comprises at least two connected insulation wall sections, which each face, at least partially, a respective side surface section of the magnetic core, at least one winding, and a coil body having the at least one winding wound thereon; comprising at least two contact elements attached to a contact strip placed on a first side of the coil body, the at least two contact elements being attached to a side surface section of the coil body and used for electrically connecting to the at least one winding, and a magnetic core accommodation in which the magnetic core accommodated in the insulation body is partially accommodated, wherein a side surface section of the magnetic core, which faces the at least two contact elements, is at least partially covered by one of the insulation wall sections of the insulation body, wherein the insulation body further comprises at least one web section, which is formed on the one of the insulation wall sections and which faces the at least two contact elements and projects outwards away from the insulation body along a normal direction of the one of the insulation wall sections, and wherein the at least one web section comprises a projecting portion projecting towards the coil body and inserted in a respective positioning opening formed in the coil body in the form of a slot and arranged on a side on which the at least two contact elements are arranged, and wherein the slot extends through a top and a bottom surface of the contact strip between two contact elements of the at least two contact elements.

2. The inductive component according to claim 1, wherein the side surface section of the magnetic core, which faces the at least one contact element, is fully covered by the insulation wall section.

3. The inductive component according to claim 1, wherein the insulation body and the coil body are mechanically connected by connection devices.

4. The inductive component according to claim 3, wherein the connection devices comprise at least one first connection element arranged on the insulation body and at least one second connection element arranged on the coil body, the connection elements entering into mechanical engagement with each other.

5. The inductive component according to claim 3, wherein the connection devices are configured for coupling the insulation body and the coil body in a mechanically releasable manner.

6. The inductive component according to claim 1, wherein the insulation body is defined by at least three insulation wall sections, which are connected to one another such that the insulation body has a pot-like or cup-like shape including a recess in which the magnetic core is accommodated.

7. The inductive component according to claim 6, wherein a depth of the recess is larger than or equal to a height dimension of the magnetic core, the height dimension being defined with respect to the magnetic core along a direction along which the magnetic core is accommodated in the recess.

8. The inductive component according to claim 1, further comprising at least one further contact element formed on a second side opposite the first side of the coil body and attached to a side surface section of the coil body, the side surface section being arranged on a coil body side located opposite the at least one contact element, a further magnetic core, and a further insulation body, the further insulation body comprising at least two insulation wall sections, which are connected to each other and which each face, at least partially, a respective side surface section of the further magnetic core, wherein the further insulation body is arranged on the coil body such that it is located opposite the insulation body, and the further magnetic core, which is accommodated in the further insulation body, is partially accommodated in the magnetic core accommodation, and wherein a side surface section of the further magnetic core, which faces the at least one further contact element, is covered, at least partially, by an insulation wall section of the further insulation body.

9. The inductive component according to claim 8, wherein each of the magnetic cores has an E-core configuration.

10. A method of manufacturing the inductive component according to claim 1, the method comprising:

winding at least one winding onto the coil body, incorporating the magnetic core into the insulation body, and attaching the insulation body with the magnetic core accommodated therein to the wound coil body, the magnetic core being partially incorporated into the magnetic core accommodation.

11. An inductive component comprising:

a coil body comprising a winding chamber containing a winding around a core reception unit, the winding chamber having opposing first and second ends with a contact strip placed on one of the first end or the second end, the contact strip having at least two contact elements coupled to the winding;

an insulation body having a plurality of insulation wall sections, said insulation body coupled to said coil body wherein one of said plurality of insulation wall sections faces and is positioned adjacent to the contact strip;

a magnetic core adapted to fit within the plurality of insulation wall sections and the core reception unit of said coil body, wherein the one of said plurality of insulation wall sections is positioned adjacent a side surface of said magnetic core; and wherein the insulation body further comprises a web section, which is formed on the one of said plurality of insulation wall sections and which faces the at least two contact elements and projects outward away from the insulation body along a normal direction to the one of said plurality of insulation wall sections, the web section being inserted in a positioning opening formed in the coil body in the form of a slot and arranged on a side on which the at least one contact element is arranged, and wherein the slot extends through a top and a bottom surface of the contact strip between two contact elements of the at least two contact elements and, whereby insulation of the inductive component is increased and leakage paths are extended.

12. The inductive component as in claim 11 further comprising:

a mechanical connection device configured to enter into mechanical engagement coupling said coil body to said insulation body.

13. The inductive component as in claim 12 wherein:

said mechanical connection device comprises the web section and the opening dimensioned to receive a portion of the web section.

14. An inductive component comprising:

a coil body comprising a winding chamber and a core reception unit, the winding chamber having opposing first and second ends with a contact strip placed on one of the opposing first and second ends, the contact strip having a contact strip surface with an opening in the form of a slot extending through the contact strip surface into the contact strip and a contact element attached to the contact strip;

an insulation body having a plurality of insulation wall sections, one of the plurality of insulation wall sections having an insulation wall surface placed on the contact strip surface over the slot;

a projecting portion formed on the one of the plurality of insulation wall sections extending from the insulation wall surface into the slot extending through the contact strip surface into the contact strip, whereby the insulation body is positioned and stabilized on said coil body and insulation of the inductive component is increased and leakage paths are extended, and wherein the contact element comprises a series of contact pins, and the slot is positioned in the contact strip between two contact pins of the series of contact pins and the slot extends through a top and a bottom surface of the contact strip adjacent the contact strip surface.

15. An inductive component as in claim 14 wherein:

the slot extends through the contact strip.

16. An inductive component as in claim 14 wherein:

the slot extends through two adjacent surfaces of the contact strip.

17. An inductive component as in claim 14 further comprising:

an extended projecting portion of said projecting portion extending out of the slot and away from the contact strip between the at least two contact elements, said extended projecting portion extending between and parallel to a longitudinal extent of the at least two contact elements and towards a distal end of each of the at least two contact elements forming a separating surface between the at least two contact elements wherein the separating surface is perpendicular to a plane containing the longitudinal extent of each of the at least two contact elements.

18. An inductive component as in claim 17 wherein:

the extended projecting portion extends beyond the distal end of the at least two contact elements.

* * * * *